United States Patent [19]

Larson

[11] Patent Number: 4,491,766

[45] Date of Patent: Jan. 1, 1985

[54] HIGH PRESSURE ELECTRIC DISCHARGE LAMP EMPLOYING A METAL SPIRAL WITH POSITIVE POTENTIAL

[75] Inventor: Daniel A. Larson, Cedar Grove, N.J.

[73] Assignee: North American Philips Lighting Corporation, New York, N.Y.

[21] Appl. No.: 391,745

[22] Filed: Jun. 24, 1982

[51] Int. Cl.[3] ..... H01J 7/44

[52] U.S. Cl. ..... 315/60; 315/59; 315/61; 315/236; 315/352

[58] Field of Search ..... 315/60, 61, 236, 237, 315/352, 59

[56] References Cited

U.S. PATENT DOCUMENTS

| | | | |
|---|---|---|---|
| 1,984,428 | 12/1934 | Pirani | 315/60 |
| 2,939,984 | 6/1960 | Edgerton | 315/237 |
| 3,619,711 | 11/1971 | Freese | 315/60 |
| 3,706,898 | 12/1972 | Peterson | 313/197 |
| 3,753,036 | 8/1973 | Roche | 315/60 |
| 3,872,340 | 3/1975 | Collins | 313/198 |
| 3,900,753 | 8/1975 | Richardson | 313/198 |
| 3,900,761 | 8/1975 | Freese | 315/60 |
| 3,982,154 | 9/1976 | Mize et al. | 315/51 |
| 4,007,397 | 2/1977 | Lake | 315/51 |
| 4,037,129 | 7/1977 | Zack et al. | 313/201 |
| 4,074,202 | 2/1978 | Scoles | 315/352 |
| 4,097,777 | 6/1978 | Bacharowski | 315/203 |
| 4,117,371 | 9/1978 | Van Vliet et al. | 315/46 |
| 4,179,640 | 12/1979 | Larson | 315/47 |
| 4,258,288 | 3/1981 | Michael et al. | 315/60 |

FOREIGN PATENT DOCUMENTS 1227810 4/1971 United Kingdom .

*Primary Examiner*—Harold Dixon

[57] ABSTRACT

A high intensity discharge lamp, for example a high pressure sodium or sodium halide lamp, which utilizes a refractory metal spiral with positive electric potential applied to it positioned around the arc tube to aid in starting and inhibit sodium migration through the arc tube during operation.

3 Claims, 6 Drawing Figures

HIGH PRESSURE ELECTRIC DISCHARGE LAMP EMPLOYING A METAL SPIRAL WITH POSITIVE POTENTIAL

BACKGROUND OF THE INVENTION

This invention relates to high intensity discharge (HID) lamps, more particularly high pressure sodium lamps and metal halide lamps containing sodium halides, both of which require a high voltage for starting and which also exhibit a tendency for the migration of sodium ions through the arc tube wall.

Different types of high intensity discharge lamps share common design requirements; in the past these criteria were addressed on a case-by-case basis for each particular lamp type. Normally each HID lamp design must employ a starting means, a means for preventing the deleterious effect of the starting aid after lamp start-up during normal operation, and means for controlling the migration of sodium through the arc tube.

The prior art utilized numerous devices for meeting the above requirements for various lamp types, as represented by the following:

U.S. Pat. No. 3,872,340 dated Mar. 18, 1975 to Collins discloses the use of an ignition coil to aid in the starting of high pressure sodium lamps. The ignition coil is made of two separate bimetallic pieces which upon lamp heat-up physically remove themselves from proximity of the arc tube as a consequence of their bimetallic construction and geometric configuration.

U.S. Pat. No. 3,900,753 dated Aug. 19, 1975 to Richardson comprises a high pressure sodium lamp composed of an arc tube containing a Penning gas mixture and an ignition coil wrapped about the outside of the arc tube. The ignition coil is electrically removed from its source of main electrode voltage after lamp heat-up by a thermal switch.

U.S. Pat. No. 4,037,129 dated July 19, 1977 to Zack et al. discloses a high pressure sodium lamp with a multiple turn ignition coil covering greater than 10% of the arc tube length. The ignition coil is electrically removed from its source of main electrode voltage after lamp heat-up by a thermal switch.

U.S. Pat. No. 4,117,371 dated Sept. 26, 1979 to Van Vliet et al. comprises a high pressure sodium lamp using a multiple turn igntion coil covering less than 10% of the arc tube length. The ignition coil is electrically removed from its source of main electrode voltage after lamp heat-up by a temperature dependent resistor.

U.S. Pat. No. 4,179,640 dated Dec. 18, 1979 to Larson shows a high pressure sodium lamp using an ignition coil that is electrically removed from its source of main electrode voltage after the main arc discharge has commenced by a high impedance capacitor or resistor.

U.S. Pat. No. 3,619,711 dated Nov. 9, 1971 to Freese discloses the use of an auxiliary electrode with a rectifying diode and current limiting resistor electrically connected between the main electrode voltage for use in a metal halide lamp.

U.S. Pat. No. 3,706,898 dated Dec. 19, 1972 to Peterson discloses a metal halide lamp that employs an auxiliary electrode to assist starting the lamp. Deleterious effects of the auxiliary electrode after start-up, during normal lamp operation, is prevented by an AC limiting, DC filtering capacitor connected thereto.

U.S. Pat. Nos. 3,900,762 dated Aug. 19, 1975 to Freese et al.; 3,982,154 dated Sept. 21, 1976 to Mize et al.; 4,007,397 dated Feb. 8, 1977 to Lake; and 4,097,777 dated June 27, 1978 to Bacharowski all reveal variations of metal halide lamps that include an auxiliary electrode and rectifying diode that perform the dual functions of acting as a voltage doubling circuit to aid in start-up and rectifying auxiliary electrode voltage to prevent degradation of the lamp during normal operation after start-up.

SUMMARY OF THE INVENTION

There is provided a HID lamp adapted to be operated at a predetermined nominal wattage input in conjunction with a ballast which limits the current through the lamp to cause it to normally operate about its nominal wattage. The lamp comprises a sealed, elongated, refractory arc tube of predetermined dimensions and design and enclosing electrodes which are operatively positioned proximate the ends thereof.

A first pair of lead-in conductors is sealed through the arc tube proximate its ends and one conductor of the first pair connects to one of the electrodes with the other conductor of the first pair connecting to the other of the electrodes. An outer light-transmitting envelope encloses the arc tube and is evacuated to provide the preferred operating environment and external electric contact means are secured to the outer envelope to provide electrical connection to the lamp, with a second pair of lead-in conductors sealed through the outer envelope and connecting to the external electrical contact means. A metallic supporting frame is retained within the outer envelope and supports the arc tube in a predetermined position. The first pair of lead-in conductors are electrically connected respectively to the second pair of lead-in conductors.

In accordance with the present construction, a lamp-starting and sodium migration-inhibiting means comprising an elongated refractory metal spiral is positioned about the outer surface of the arc tube encompassing at least a portion of the circumference and at least a portion of the axial length of the arc tube. The metal spiral is in electrical connection with one or both main electrodes through a voltage rectifying means that imparts to the metal spiral a positive potential over each alternating current cycle. For at least half of each alternating current cycle the rectified voltage applied to the metal spiral will be positive and opposite that of one of the main electrodes. Because of the physical proximity of the metal spiral to the main electrode(s) with opposite electrical potential to itself, local ionization and an incipient discharge will be induced. Electrons from this incipient discharge are accelerated by the field in the arc tube and cause the main discharge to occur. The metal spiral is not physically removed or electrically disconnected from its source of electrical potential after lamp start-up and the positive voltage applied will serve to inhibit sodium migration through the arc tube walls usually induced by other means.

BRIEF DESCRIPTION OF THE DRAWINGS

For a better understanding of the invention, reference may be had to the preferred embodiment, exemplary of the invention, shown in the accompanying drawings, in which.

DESCRIPTION OF THE PREFERRED EMBODIMENT

Figure 1:
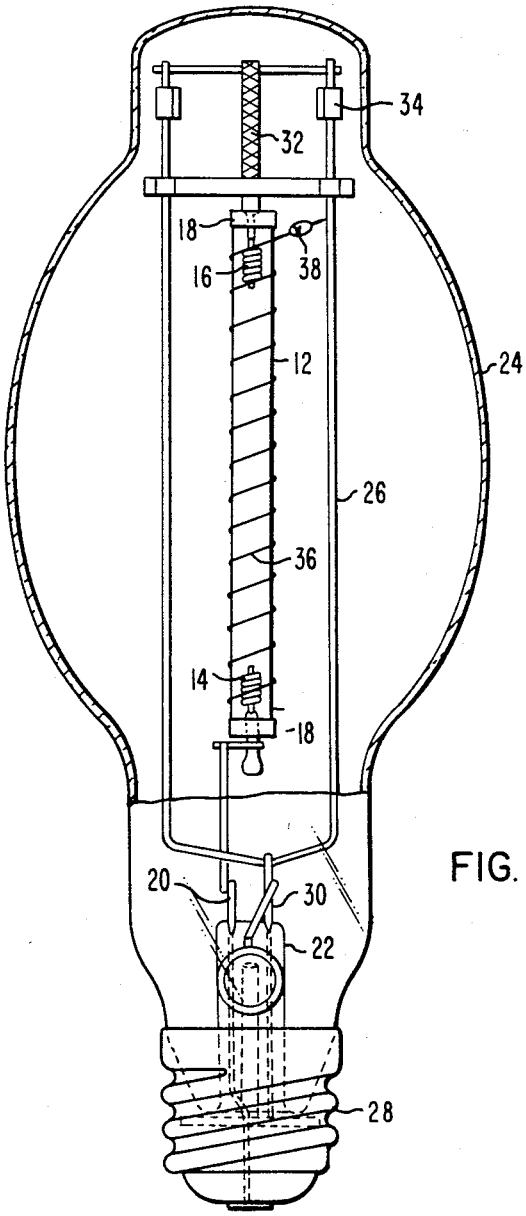
FIG. 1 is an elevational view shown partly in section of a high pressure sodium vapor lamp constructed in accordance with the present invention using a single diode between a main electrode and the metal spiral as the voltage rectifying means.

Referring now in detail to the drawings wherein alternative forms and applications of the invention are shown, there is illustrated in FIG. 1 an otherwise typical HID high pressure sodium lamp comprising a radiation transmitting arc tube 12 having electrodes 14 and 16 operatively supported therein proximate the ends thereof and adapted to have an elongated arc discharge maintained therebetween. The arc tube is fabricated of refractory materials such as single crystal or polycrystalline alumina having end caps 18 sealed to the ends thereof. One lead-in conductor 20, sealed through a conventional stem press arrangement 22 for connection to the conventional lamp base 28, connects to the lower lamp electrode 14. The arc tube 12 is suitably supported within a protective outer envelope 24 in order to provide a predetermined operating environment, preferably a vacuum, by means of a supporting frame 26 which is connected to the other lead-in conductor 30. Electrical connection to the uppermost electrode 16 is made through the frame 26 and a resilient braided connector 32 to facilitate expansion and contraction of the arc tube 12. The frame 26 is maintained in position within the bulb by suitable metallic spring spacing members 34 which contact the inner surface of the dome portion of the protective envelope 24. As a discharge sustaining filling, the arc tube contains a small controlled charge of sodium or sodium-mercury amalgam and a low pressure of inert ionizable starting gas such as 20 torrs of neon-/argon or xenon.

Around the outer surface of the arc tube 12 there is provided a metal spiral which comprises an elongated refractory metal member 36 which encompasses at least a portion of the circumference and at least a portion of the axial length of the arc tube 12. The fraction of, or multiple of, coil turns and fraction of tube length spanned by the metal member are predetermined by considering the fill gas composition, fill gas pressure, lamp wattage, and lamp operating environment, e.g., ambient starting temperature. The elongated refractory metal member is preferably formed of tantalum, niobium, or tungsten wire having a diameter of 0.25 mm. and is wrapped with ten turns, for example.

The metal spiral 36 connects to a diode 38 oriented in such a manner to allow only positive potential to be applied to the metal spiral which in turn connects to and extends from the supporting frame 26, a source of main electrode voltage.

The small diameter of a high pressure sodium arc tube usually results in increased starting voltage requirements over mercury or metal halide lamps. In addition the arc tube end seal construction of a high pressure sodium lamp does not lend itself to incorporation of an auxiliary starting electrode inside the arc tube as does a mercury or metal halide lamp to allow a reduction in starting voltage. For high pressure sodium lamps, therefore, it has become the usual practice to utilize circuitry in the ballast to generate a periodic high-voltage starting pulse with a duration of several microseconds and a peak in excess of 2,000 volts until the lamp ignites. The pulse generator is then disabled and the lamp operates from the ballast voltage. This system further requires that associated lighting components be made capable of withstanding the high pulse voltage for the long periods of time subsequent to lamp failure and prior to replacement.

In the present invention illustrated in FIG. 1 the diode 38 operates as a switch which is in the closed or shorted position when the frame 26 is at a positive potential and is an open circuit when the frame is at a negative potential. The electrical potential difference between the metal spiral and main electrode(s) and the physical proximity therewith will result in local ionization in the region of the inert starting gas and cause an incipient discharge to occur between the main electrode and the inner wall portion of the arc tube 12 which is proximate the metal spiral 36 because of capacitive coupling. Electrons from this incipient discharge are accelerated by the field in the arc tube and cause the main discharge to strike between the main electrodes 14 and 16.

High pressure sodium lamps filled with a Penning mixture of neon/argon utilizing this principle have been reliably operated on mercury lamp ballasts that do not utilize a high voltage starting pulse; high pressure sodium lamps without a Penning mixture fill gas (e.g. xenon) can be started on regular high pressure sodium lamp ballasts.

Other art using ignition coils applies nonrectified voltage and therefore requires a mechanical or electrical means for removing the applied voltage from the coil to prevent the coil on the negative half cycle from electrically attracting $Na^+$ ions and thereby causing sodium migration.

Electrical attraction by some form of the AC source voltage is not the only cause of sodium migration through the arc tube. Another mechanism of significance is ionic pumping of sodium to the tube walls. Sodium ions diffuse to the walls by ambipolar diffusion—the movement in a plasma of charged particles as a result of the nearly exact requirement of local charge neutrality. Atoms are ionized near the center of the arc tube and pumped to the polycrystalline alumina walls by ambipolar diffusion; their return as neutral atoms is a much slower process. Sodium then migrates through the polycrystalline alumina arc tube wall by reaction with chemical impurities or through passages along grain boundaries. To compensate for this sodium loss process, sodium vapor lamps are operated with an excess of sodium-mercury amalgam. The partial pressures of sodium and mercury in the arc tube, therefore, depend on the temperature of the coldest spot—where the excess amalgam condenses. Darkening of the arc tube, temperature and pressure increases in the arc tube, and changes in the voltage drop across the arc making ballast wattage control difficult, are resultant problems.

By applying a positive potential to the metal spiral at all times during lamp operation, the $Na^+$ ions are repelled by the potential and are essentially prevented from migrating through the tube wall.

Figure 2:
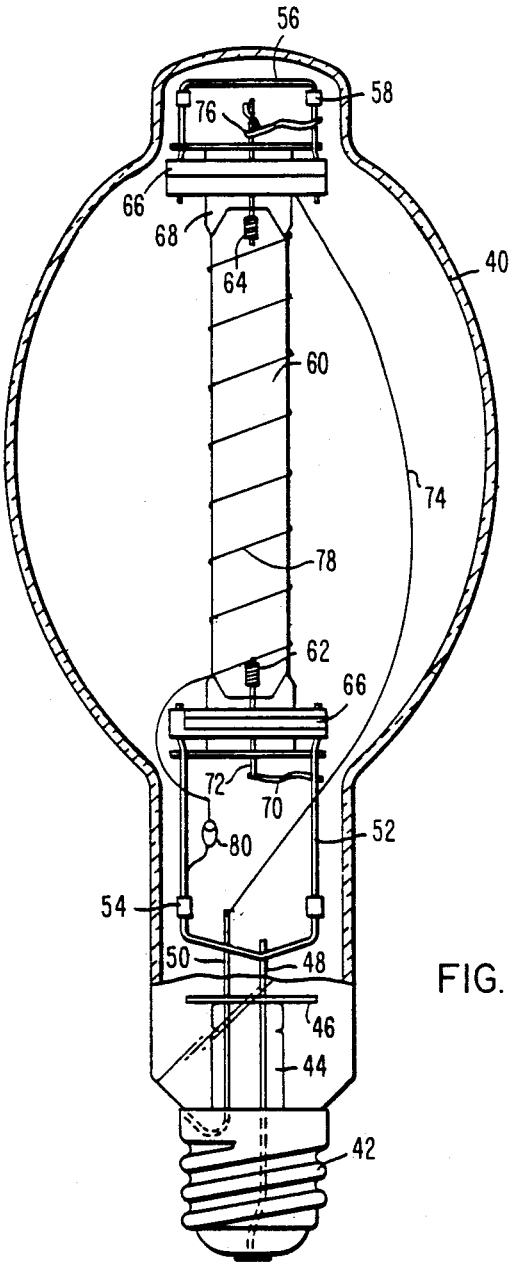
FIG. 2 is an elevation view shown partly in section of a metal halide lamp constructed in accordance with the present invention using a single diode between a main electrode and the metal spiral as the voltage rectifying means.

As an alternative embodiment there is illustrated in FIG. 2 an otherwise typical HID metal halide lamp which includes a bulbous tubular outer envelope 40 sealed to a standard mogul base 42 and includes a reentrant stem press 44 which has mounted thereon a heat reflecting disk shield 46 and a pair of lead-in conductors 48 and 50 extending therethrough and electrically connected to the base 42. The lower support frame 52 is mounted to the lead-in conductor 48 and is supported within the tubular neck of the bulb in a conventional manner by springs 54. A shorter but similar frame 56 is mounted in the upper tubular end of the bulb and is retained therein by springs 58. Mounted between the lower frame 52 and the upper frame 56 is a conventional quartz arc tube 60 containing sodium iodide, scandium iodide and mercury having a pair of discharge sustaining electrodes 62 and 64 mounted in each end thereof. The arc tube is mounted to the upper and lower support frames 52 and 56 by metal support straps 66 which extend between the legs of the support frames and clamp the press seals 68 at each end of the arc tube. A connector 70 electrically connects the lower frame 52 to the rod or lead 72 of the lower electrode 62. A field wire or lead wire 74 interconnects the lead-in conductor 50 to the lead 76 of the upper electrode 64 to energize the upper electrode 64 in a conventional manner.

Around the outer surface of the arc tube 60 there is provided a metal spiral which comprises an elongated refractory metal member 78 that is connected to the diode 80 oriented in such a manner to allow only positive potential to be applied to the metal spiral, said diode in turn connects to and extends from the lower supporting frame 52, a source of main electrode voltage.

The parameters of the metal spiral that may be varied and their range of variation are the same as those described above for the high pressure sodium lamp, although the exact values will be different because of changes in the lamp design parameters also stated above.

Unlike crystalline alumina which cannot be flameworked, glasses may be worked within a range of temperature and fused vitreous seals may be formed. This ease with which glass arc tubes may be sealed has led to the use of an additional or auxiliary electrode next to one of the main electrodes to facilitate ionization and starting discharge. Although once the lamp has started the auxiliary electrode is surrounded by a plasma whose potential is nearly the same as that of the nearby electrode and little current flows, the heavier mass of the $Na^+$ ions compared to the electrons causes the probe ion current to be 0.002 of the probe electron current. Direct current voltages in hot glass cause migration of sodium ion impurities in the glass toward the electrode and cause local glass seal failures. Auxiliary electrodes are, therefore, usually disconnected from their source of potential either mechanically or electrically, or the applied voltage is rectified to prevent electrolysis. In accordance with the invention, an auxiliary starting electrode is not required; lamp starting is accomplished in the same manner as it is for high pressure sodium discharge lamps by applying rectified positive voltage to the coil. Sodium migration is, therefore, not induced.

As with high pressure sodium lamps the possibility of sodium migration induced by the starting aid is not the only source of $Na^+$ ions of concern. Because metal halide arc lamps contain sodium iodide as one of the arc tube filling ingredients and NaI is added in excess to the arc tube, sodium loss creates free iodine which then combines with the mercury to form $HgI_2$, which is detrimental to the lamp.

This second mechanism of sodium migration is electrolysis of the sodium through the arc tube glass induced by photoelectrons on the outside tube surface that are emitted by metal in the lamp as the metal absorbs ultraviolet light from the arc tube. The photoelectrons are attracted by the positive areas of the arc tube but are never re-emitted because glass does not photoemit electrons for radiations of the wavelengths present. A large negative potential therefore accumulates on the outer arc tube surface and is an attraction for $Na^+$ ions which migrate through the glass, combines with an electron, and evaporates as a sodium atom. Attempts to eliminate the source of the photoelectrons by minimizing the size of the conductors in the arc tube radiation area and by increasing the distances between conductors and arc tube are successful only if there is a fill gas in the outer jacket to prevent electrons from reaching the arc tube. Fill gas, however, reduces lamp efficiency by facilitating arc tube heat loss.

The present invention maintains a positive bias on the outer surface of the arc tube at all times eliminating the negative potential caused by the photoelectrons and preventing the migration of sodium. Since an outer jacket fill gas is no longer required, a vacuum outer jacket may be used in conjunction with the present invention to increase lamp efficiency.

Figure 3:
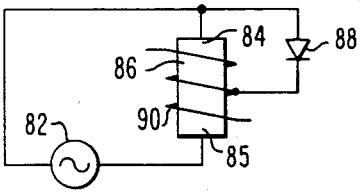
FIG. 3 is a diagrammatic view of the rectifying means employed in FIGS. 1 and 2 constructed to provide half wave rectification.

FIG. 3 displays in electrical diagrammatic form the rectifying device that provides positive half wave rectification to the metal spiral employed in FIGS. 1 and 2 and described above. Illustrated is an HID regulated voltage source 82 consisting of a source of line voltage and lamp ballast with associated electronics. The voltage source 82 is electrically connected to the lamp electrodes 84 and 85 via lead-in conductors through the arc tube 86. A first diode 88 is electrically connected between the metal spiral 90 and the first side of the voltage source 82 in parallel electrical connection with the first electrode 84.

Figure 4:
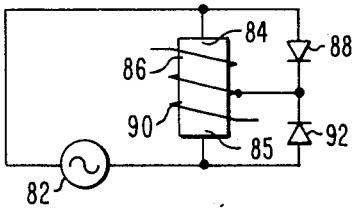
FIG. 4 is a diagrammatic view of an alternative rectifying means using two diodes each between respective main electrodes and the metal spiral to provide full wave rectification.

FIG. 4 displays in electrical diagrammatic form an alternative rectifier means for providing positive full-wave rectification to the metal spiral 90. In addition to the elements described in FIG. 3, this means comprises a second diode 92 electrically connected between the metal spiral 90 and the second side of the voltage source 82 in parallel electrical connection with the second electrode 85.

Figure 5:
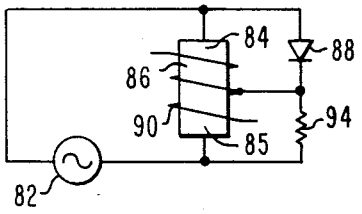
FIG. 5 is a diagrammatic view of an alternative rectifying means using one diode and one resistor, the diode connected between one main electrode and the metal spiral, and the resistor connected between the other main electrode and the metal spiral.

FIG. 5 displays in electrical diagrammatic form an alternative rectifier means for providing substantially positive electric potential to the metal spiral 90. In addition to the elements described in FIG. 3, this means comprises a resistor 94 electrically connected between the metal spiral 90 and the second side of the voltage source 82 in parallel electrical connection with the second electrode 85. The resistor 95 value must be small relative to the back resistance of the diode 88 in order to supply positive potential to the metal spiral during the half cycle when the second electrode 85 is positive. A typical resistor value is 40.000 ohms. With this rectifying means the metal spiral may be several volts negative with respect to the second electrode 85, but will be positive relative to any point in the discharge.

Figure 6:
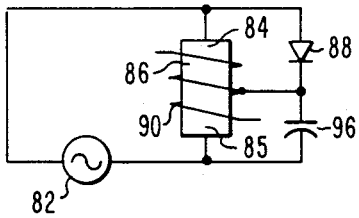
FIG. 6 is a diagrammatic view of an alternative rectifying means using one diode and one capacitor, the diode connected between one main electrode and the metal spiral, and the capacitor connected between the other main electrode and the metal spiral.

FIG. 6 displays in electrical diagrammatic form an alternative rectifier means utilizing a diode clamp circuit for providing positive electric potential to the metal spiral 90. In addition to the elements described in FIG. 3, this means comprises a capacitor 96 electrically connected between the metal spiral 90 and the second side of the voltage source 82 in parallel electrical connection with the second electrode 85. With the diode 88 connected to the first electrode 84 and the metal spiral 90 and the capacitor 96 connected to the cathode of the diode the metal spiral will always be at a positive potential relative to the discharge adjacent to it. When the first electrode 84 is positive the diode is essentially a short circuit and the potential of the metal spiral is that of the positive electrode. During this half cycle the capacitor charges to the full lamp voltage. When the potential reverses, the diode imposes a high impedance and the capacitor requires most of the half cycle to discharge and the metal spiral does not fall below the potential of the second electrode 85. A typical capacitor value is 200 pico farad.

I claim:

1. In a high-intensity discharge lamp of the type having an arc discharge tube including a pair of discharge electrodes and containing an ionizable material for sustaining an arc discharge when said discharge electrodes are sufficiently electrically biased, the improvement comprising: a spiral metal conductor wound about the outer surface of said arc tube; and a biasing circuit for positively biasing said spiral metal conductor, said biasing circuit consisting essentially of a first diode connected to one of said discharge electrodes and to said spiral metal conductor and having a polarity effective to electrically positively bias said spiral metal conductor, and a second diode connected to the second of said discharge electrodes and to said spiral metal conductor and said first diode and having a polarity effective to positively electrically bias said spiral metal conductor, and said biasing circuit being free of reactive circuit elements.

2. In a high-intensity discharge lamp according to claim 1, said ionizable material comprising sodium.

3. In a high-intensity discharge lamp according to claim 1, said ionizable material comprising one of the materials selected from the group consisting of sodium, a sodium-mercury amalgam, and a sodium halide compound.

* * * * *